US009144840B2

(12) United States Patent
Ikeda et al.

(10) Patent No.: US 9,144,840 B2
(45) Date of Patent: Sep. 29, 2015

(54) ELECTROMAGNETIC STIRRER AND CONTINUOUS CASTING METHOD

(71) Applicant: NIPPON STEEL & SUMITOMO METAL CORPORATION, Tokyo (JP)

(72) Inventors: Tatsuhiko Ikeda, Wakayama (JP); Nobuhiro Okada, Tokyo (JP); Hiroshi Hayashi, Wakayama (JP); Masahiro Yamazaki, Wakayama (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/380,486

(22) PCT Filed: Aug. 27, 2013

(86) PCT No.: PCT/JP2013/072861

§ 371 (c)(1),
(2) Date: Aug. 22, 2014

(87) PCT Pub. No.: WO2014/034658

PCT Pub. Date: Mar. 6, 2014

(65) Prior Publication Data

US 2015/0158079 A1 Jun. 11, 2015

(30) Foreign Application Priority Data

Aug. 29, 2012 (JP) ..... 2012-188933

(51) Int. Cl.

| | |
|---|---|
| ***B22D 11/115*** | (2006.01) |
| ***B22D 11/12*** | (2006.01) |
| ***B22D 11/041*** | (2006.01) |

(52) U.S. Cl.
CPC ..... *B22D 11/115* (2013.01); *B22D 11/041* (2013.01); *B22D 11/122* (2013.01)

(58) Field of Classification Search
CPC ..... B22D 11/115; B22D 11/122
See application file for complete search history.

(56) References Cited

FOREIGN PATENT DOCUMENTS

| | | |
|---|---|---|
| CN | 101720262 | 6/2010 |
| CN | 102107266 | 6/2011 |
| JP | 60-44157 | 3/1985 |
| JP | 10-230349 | 9/1998 |
| JP | 2006-289448 | 10/2006 |
| JP | 2007-007719 | 1/2007 |

*Primary Examiner* — Kevin P Kerns
*Assistant Examiner* — Steven Ha
(74) *Attorney, Agent, or Firm* — Clark & Brody

(57) ABSTRACT

The present invention provides an electromagnetic stirrer uniformly applying an electromagnetic force to each casting mold. The electromagnetic stirrer of the present invention includes a pair of electromagnetic coils including a casting mold(s) between them, wherein an inner winding is applied to outside of each of two of tooth provided to a core of each of the pair of electromagnetic coils, an outer winding is applied to outside of the inner windings, ways of applying current to be applied to the windings are changed depending on the distance of the electromagnetic coils, and the number of the casting molds n, the external size ϕ, and the width of each of the electromagnetic coils W are defined as n×ϕ<W.

2 Claims, 11 Drawing Sheets

ELECTROMAGNETIC STIRRER AND CONTINUOUS CASTING METHOD

TECHNICAL FIELD

The present invention relates to an electromagnetic stirrer capable of uniformly controlling flow of molten steel in one or more of casting mold (s) in a continuous casting apparatus for billet having round or angular cross section, and a continuous casting method using the electromagnetic stirrer.

BACKGROUND ART

Cast billets each having a round or angular cross section, going through steps of tubemaking and rolling, are used as materials of seamless pipes and shape steels having different sizes in cross section. Since the seamless pipes and shape steels have various kinds of product sizes and different rolling steps, the cast billets to be their base materials also have a variety of cross-sectional shapes. Therefore, a casting in which the number of casting mold is determined depending on production capacity is carried out.

Here, among cast slabs produced by means of a continuous casting or among rolling steel ingots after an ingot casting, a cast slab or ingot having a regular-square cross section or round cross section is defined as a billet, and a cast slab or ingot having a rectangle cross section is defined as a bloom. Also, in the billet, a billet having a regular-square cross section is defined as a square billet, and a billet having a round cross section is defined as a round billet.

A continuous casting will be described with reference to FIG. 1 that is a longitudinal cross-sectional view of a configuration example of a continuous casting system 100 for billet to which the present invention can be applied, wherein the continuous casting system 100 is seen from a lateral side. In FIG. 1, 1 is a tundish, 2 is a molten steel, 3 is a submerged nozzle, 4 is a casting mold, 5 is an electromagnetic stirrer, 6 is a casting roll positioned right below the casting mold, 7 is a zone of roller aprons including a secondary cooling spray zone, 8 is a solidifying shell, 9 is pinch rolls, and 10 is a cast slab.

In the continuous casting, the molten steel 2 poured from a ladle to the tundish 1 is teemed to the casting mold 4 via the submerged nozzle 3. While the molten steel 2 teemed to the casting mold 4 is drawn along a group of casting rolls 6 by the rotational drive of the pinch rolls 9, surface of the solidifying shell 8 is cooled by the second cooling spray zone to proceed solidification, whereby the cast slab 10 is made.

In the continuous casting, it is extremely important to control flow of molten steel in a casting mold in view of operation and quality of cast slab, for instance in view of melt stabilization of mold powder by supplying heat to meniscus and inclusion removal at a surface of cast slab. As a method for controlling flow of molten steel in a casting mold, an electromagnetic stirring applying electromagnetic force to the molten steel in the casting mold and stirring the molten steel is widely known. In a case where the electromagnetic stirring is operated with a plurality of casting molds, it is necessary to apply the electromagnetic force to each of the plurality of casting molds such that the casting molds have a uniform flow.

As methods for applying the electromagnetic force for electromagnetic stirring, a rotational shifting magnetic field type and a linear shifting magnetic field type are exemplified.

The rotational shifting magnetic field type is applied to continuous castings of billet, bloom and the like, and the rotational shifting magnetic field type is a method to obtain a uniform flow by applying a rotating magnetic field to inside of casting mold by means of a plurality of magnetic poles provided along whole circumference of the casting mold (for example, Patent Document 1).

However, in a case where the rotational shifting magnetic field type is applied to a plurality of casting molds, since an electromagnetic stirrer is needed for each of the casting molds, the number of installation of the electromagnetic stirrer is increased and the plurality of casting molds become unable to share a strand due to increase in size of the casting molds, which causes increase in equipment cost.

On the other hand, as the linear shifting magnetic field type, the applicant of the present invention has proposed, in Patent Document 2, an electromagnetic coil in which two of tooth 12 are provided to a core 11 of an iron core of a coil in a projecting manner to a side of a casting mold 4, an inner winding is applied to each of the two of tooth 12, and in addition, an outer winding is applied to the outside of the two of tooth 12 to unify the two of tooth 12. The electromagnetic coil proposed in Patent Document 2 will be described with reference to FIG. 2A. This electromagnetic coil shifts a magnetic field in a linear manner, by applying three-phase alternating currents A, B and C each having a phase difference of 120° to each other to an inner winding 13 and an outer winding 14 as shown in FIG. 2A. Hereinafter, this electromagnetic coil is referred to as a pie-shaped electromagnetic coil.

An electromagnetic stirrer including this pie-shaped electromagnetic coil has a large magnetic flux since the magnetic field in a phase where the outer winding is applied goes in the same direction, and in a case where an electromagnetic force is applied to a casting mold having a large cross section, it is possible to obtain a favorable electromagnetic force along whole circumference of the casting mold (see FIG. 6A).

However, in a case where a plurality of casting molds each having a small cross section are installed between the pie-shaped electromagnetic coils, since the space L between the pie-shaped electromagnetic coils becomes narrow, the magnetic flux component going through the casting mold 4 becomes too strong, whereby shifting magnetic field becomes difficult to be made, which results in a creation of a discontinuous region in the electromagnetic force (see the distortion of the electromagnetic force at the non-uniform flowing part in FIG. 6B).

CITATION LIST

Patent Literatures

Patent Document 1: Japanese Patent Application Laid-Open Publication No. H10-230349

Patent Document 2: Japanese Patent Application Laid-Open Publication No. S60-44157

SUMMARY OF THE INVENTION

Problems to be Solved by the Invention

A problem to be solved by the present invention is that, in a case where electromagnetic stirrers of rotational shifting magnetic field type are applied to a plurality of casting molds, since an electromagnetic stirrer is required for each of the casting molds, the number of installation of the electromagnetic stirrer increases, and the plurality of casting molds cannot share a strand due to increase in size of the casting molds. Also, another problem to be solved by the present invention is that, in a case where a plurality of casting molds each having a small cross section are installed, the space between coils becomes narrow, the magnetic flux component going through the casting molds becomes too strong, whereby shifting magnetic field becomes difficult to be made, which results in creation of a discontinuous region in the electromagnetic force, which can occur at an electromagnetic stirrer including a pie-shaped electromagnetic coil.

Means for Solving the Problems

The present invention has following configurations, for one or more of casting mold(s), in order to stabilize slab quality by applying a uniform electromagnetic force to straighten out flow of the molten steel inside the casting molds using an electromagnetic stirrer having a pair of pie-shaped electromagnetic coils.

That is, a first aspect of the present invention is an electromagnetic stirrer 5, including electromagnetic coils C1 and C2, wherein a casting mold 4 including a plurality of strands is disposed between the electromagnetic coils C1 and C2 at predetermined intervals, and three-phase alternating currents each having a phase difference of 120° to each other are applied.

At this time, as the electromagnetic coils C1 and C2, pie-shaped electromagnetic coils C1 and C2 are employed, the pie-shaped electromagnetic coils C1 and C2 having a configuration in which: two tooth parts 12 are provided to a core 11 of each of the electromagnetic coils C1 and C2 in a projecting manner to a side of a casting mold 4 (two convex portions 12 projected to the side of the casting mold 4 are provided to the core 11 of each of the electromagnetic coils C1 and C2); an inner winding 13 is applied to the outside of each of the tooth parts 12; and an outer winding 14 is further applied to the outside of the two tooth parts 12 with the inner winding 13 to unify the two tooth parts 12.

For example, as shown in FIGS. 2A and 2B, three-phase currents A, B and C each having a phase difference of 120° to each other are applied to the pie-shaped electromagnetic coils C1 and C2 having the configuration described above. The right and left direction of plane of paper of FIGS. 2A and 2B is a casting direction. The method shown in FIG. 2A is a method in which the currents A, B and C are applied in a manner that the magnetic flux of the outer winding faces a same direction by applying currents in a same direction to the outer winding 14. The method shown in FIG. 2A is a method in which the currents A, B and C are applied in the following manner: for the electromagnetic coil C1 (lower side of plane of paper) that is one of the pair of electromagnetic coils, the currents A, B and C are applied such that the direction of the currents becomes, from one end side to the other end side of the casting direction, −B, +C, −C, +A, −A, +B, in the order mentioned; and for the electromagnetic coil C2 (upper side of plane of paper) that is the other of the pair of electromagnetic coils, the currents A, B and C are applied such that the direction of the currents becomes, from one end side to the other end side of the casting direction, −B, +A, −A, +C, −C, +B in the order mentioned (hereinafter, this configuration is referred to as "window-type wiring system"). Also, the method shown in FIG. 2B is a method in which the currents A, B and C are applied in the following manner: for the electromagnetic coil C1 (lower side of plane of paper) that is one of the pair of electromagnetic coils C1 and C2, the currents A, B and C are applied such that the direction of the currents becomes, from one end side to the other end side of the casting direction, −B, +C, −C, +A, −A, +B in the order mentioned; and for the electromagnetic coil C2 (upper side of plane of paper) that is the other of the pair of electromagnetic coils C1 and C2, the currents A, B and C are applied such that the direction of the currents becomes, from one end side to the other end side of the casting direction, +B, −A, +A, −C, +C, −B in the order mentioned, as the directions are symmetrical about a point centering the center of a horizontal section of the casting mold 4 (hereinafter, this configuration is referred to as "symmetric wiring system").

At this time, in order to unify the electromagnetic force working in a circumferential direction at an arbitrary position in a radius direction inside the casting mold 4, a distance L between the electromagnetic coils C1 and C2 disposed facing to each other is determined as no more than 500 mm when the symmetric wiring system is applied, and 500 mm or more when the window-type wiring system is applied.

In the present invention, the reason for setting the value 500 mm as the bases of division is to secure the distance L between the electromagnetic coils C1 and C2, when sharing a frame of casting mold depending on the diameter of casting mold to be used in a single casting and a twin casting.

Also, when the number of casting molds per the pair of electromagnetic coils (the number of the casting molds 4 disposed in the region between an end surface of one end side and an end surface of the other end side of the casting direction of the pair of electromagnetic coils C1 and C2) is defined as n, the external size of each of the casting molds (in a case of round billet, the outer diameter of mold copper plate, and in a case of angular billet, outer width of long side of mold copper plate) is defined as ϕ (mm), the width of the electromagnetic coil is defined as W (mm), the number of the casting molds is determined so as to satisfy the following Formula (1).

$$n \times \phi < W \tag{1}$$

A second aspect of the present invention is a continuous casting method using an electromagnetic stirrer, the method including using the electromagnetic stirrer 5 according to the first aspect of the present invention as the electromagnetic stirrer, and setting the minimum value Vmin of the flowing speed of molten steel to a circumferential direction of casting mold in the vicinity of the casting mold after meniscus as 10 cm/s (10 cm per second) or more. Such a configuration makes it possible to apply the electromagnetic force equally to each casting mold 4. Here, "the vicinity of the casting mold" means an area where flow can be applied to the molten steel by means of the electromagnetic stirrer 5, and as one example, a region having a distance of 100 mm or less from the wall surface of the casting mold having contact with the molten steel.

Effects of the Invention

In the present invention, in a continuous casting apparatus in which one or more of casting mold(s) is/are used for casting at the same time, it is possible to apply the electromagnetic force to each casting mold 4, by means of the electromagnetic stirrer 5 including the pair of electromagnetic coils C1 and C2. As a result, since there becomes no need to install an electromagnetic stirrer individually to each casting mold, it is possible to hold down the equipment cost. Also, since the symmetric wiring system or the window-type wiring system is applied depending on the distance L between the electromagnetic coils C1 and C2, it is possible to prevent a discontinuous region from being generated in the electromagnetic force.

MODES FOR CARRYING OUT THE INVENTION

An object of the present invention is, for casting molds having a various sizes, to apply an electromagnetic force uniformly to inside of one or more of the casting mold(s) by means of a shared electromagnetic stirrer. The present invention satisfies the following conditions.

Figure 6A:
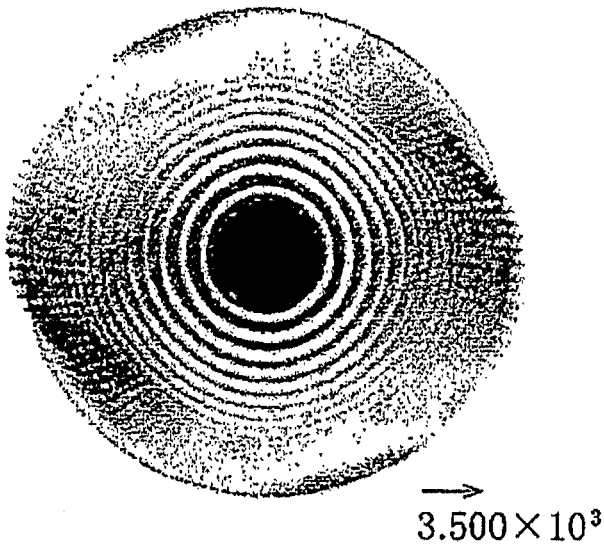
FIG. 6A is a view showing an electromagnetic force in a case where the symmetric wiring system is employed, the view showing an analysis result in a case where one casting mold whose outer diameter is 360 mm is installed.
Figure 6B:
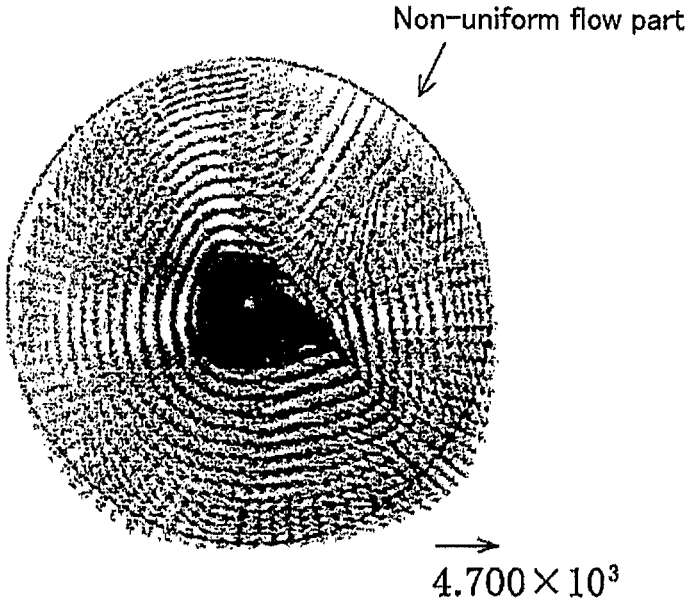
FIG. 6B is a view showing an electromagnetic force in a case where the symmetric wiring system is employed, the view showing an analysis result in a case where two casting molds each having an outer diameter of 180 mm are installed.

The inventors of the present invention carried out electromagnetic field analyses using a calculation model, regarding the wiring systems employed when the currents having phase differences are applied to each electromagnetic coil of the electromagnetic stirrer (see FIGS. 5A to 6B). Both "$3.500\times10^3$" in FIGS. 5A and 6A, and "$4.700\times10^3$" in FIGS. 5B and 6B are Lorenzian density ($N/m^3$). Arrows in FIGS. 5A, 5B, 6A and 6B each shows a direction of a force which the molten steels are to be received by the electromagnetic force.

As a result, the inventors have found out as follows. When a casting mold having a small cross section is employed in which the distance L between the electromagnetic coils C1 and C2 is no more than 500 mm, in the window-type wiring system shown in FIG. 2A, a stagnated part is formed in the electromagnetic force. On the other hand, by changing the system to the symmetric wiring system and applying the currents A, B and C each having a phase difference of 120° to each other to the inner winding 13 and the outer winding 14, an electromagnetic force is applied equally over the entire circumference of the casting mold 4.

It should be noted that, when the symmetric wiring system is applied to a case where a casting mold having a large cross section is employed in which the distance L between the electromagnetic coils C1 and C2 is 500 mm or more, although there is no stagnated part of the electromagnetic force generated, the flowing speed of the molten steel is reduced since the electromagnetic force is weak comparing with the window-type wiring system. Therefore, in a case where a casting mold having a large cross section is employed and the distance L between the electromagnetic coils C1 and C2 is 500 mm or more, it is preferred to employ the window-type wiring system shown in FIG. 2A.

Also, when the number of casting molds per the pair of electromagnetic coils (the number of casing molds to be disposed in a region between an end surface of one end side and an end surface of the other end side of the casting direction of the pair of electromagnetic coils C1 and C2) is defined as n, the outer size of each casting mold is defined as $\phi$ (mm), and the width of the electromagnetic coil is defined as W (mm), a reason of defining the casting molds so as to satisfy the above Formula (1) is, to prevent a generation of a region where the electromagnetic force is not applied as a result of installing a plurality of casting molds each having excessive size between the pair of electromagnetic coils C1 and C2 whereby the casting mold 4 runs off from the tooth part 12 which is a center of generation of the electromagnetic force. Another reason is, in a case where a plurality of the casting molds 4 are installed as well, to apply a uniform electromagnetic force to all of the casting molds 4, considering that the electromagnetic force by the electromagnetic stirrer 5 is applied in a direction perpendicular to the tooth part 12.

This is the electromagnetic stirrer 5 of the present invention.

Figure 1:
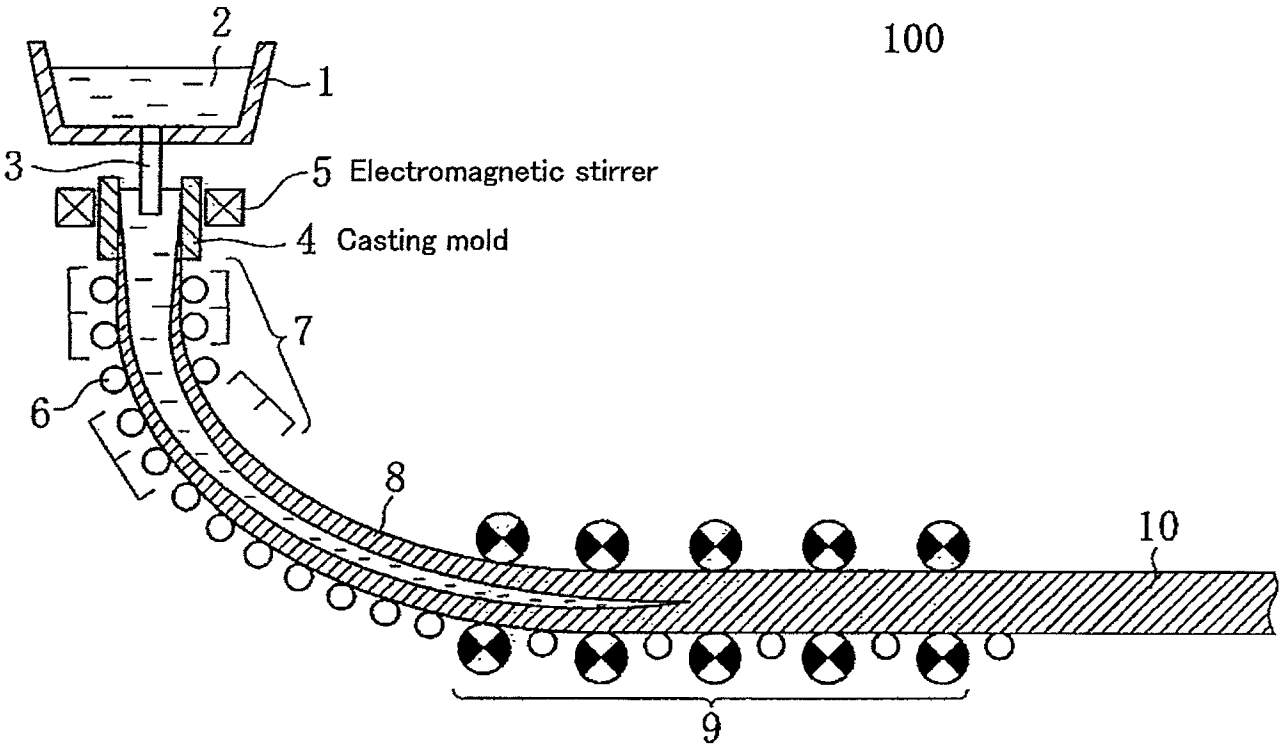
FIG. 1 is a longitudinal cross-sectional view of a configuration example of a continuous casting system 100 for billet seen from a lateral side.

Next, the inventors of the present invention examined, using the continuous casting system 100 shown in FIG. 1, including the electromagnetic stirrer 5 of the present invention, the relationship between the incidence (%) of surface defection of casting slabs and the minimum value (cm/s) of the flowing speed of molten steel in the vicinity of the wall of casting molds generated by the electromagnetic stirring by means of the stirrer of the present invention.

Here, regarding the incidence of surface defection of cast slabs, the examination was carried out targeting at powder defects. The number of cast slabs in which the powder defect is occurred to the total number of cast slabs of 10 to 50 (vary depending on the diameter of casting mold) of one charge of casting is defined as the incidence (%) of surface defection of cast slabs for evaluation.

Regarding the flowing speed of molten steel, samples of horizontal section were collected from the round billets of Examples described below, and deflection angles of dendrite generated having a distance of 10 mm from the surface skin were measured with respect to whole circumference of the casting mold with intervals of 15 degrees each (24 points in total), and among the values obtained by converting the measurement values, the minimum value was defined as Vmin.

Figure 3:
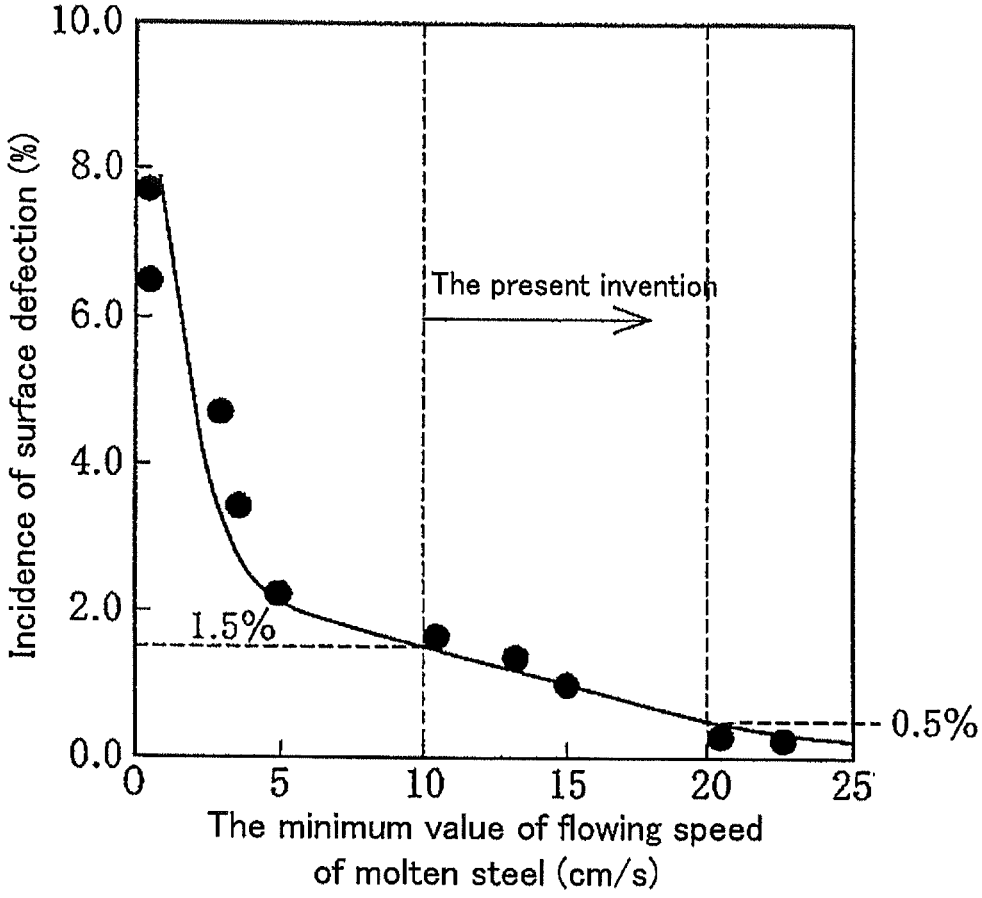
FIG. 3 is a view showing a relationship between the minimum value of the flowing speed of molten steel in a casting mold and incidence of surface defect of cast slabs.
Figure 7:
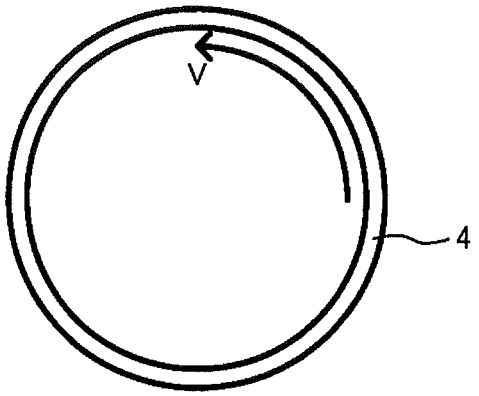
FIG. 7 is a view describing a flowing speed V of molten steel to a circumferential direction of casting mold in the vicinity of a casting mold 4.

As a result, the inventors have found out that, as shown in FIG. 3, the incidence of surface defection of cast slabs increases as the minimum value of the flowing speed of molten steel decreases. Accordingly, finding that it is desirable to determine the wiring system and the number of casting molds so as to secure the minimum value of the flowing speed of molten steel by the electromagnetic stirring in the vicinity of the casting mold after meniscus of 10 cm/s, so that the incidence of the surface defection of cast slabs is to be no more than 1.5% with which the defection can be handled by trimming. The expression "can be handled by trimming" means that, the defective part on the surface of cast slabs can be removed by grinding the surface of cast slabs by 1 to 5 mm by means of a grinder and the like. The same meaning is applied hereinafter as well. FIG. 7 shows a flowing speed V of molten steel to a circumferential direction of casting mold in the vicinity of the casting mold 4.

In the continuous casting method of the present invention, in view of further decreasing the incidence of the surface defection of cast slabs, it is preferred that the minimum value of the flowing speed of molten steel in the vicinity of the wall of casting mold after meniscus is 20 cm/s or more.

Figure 2A:
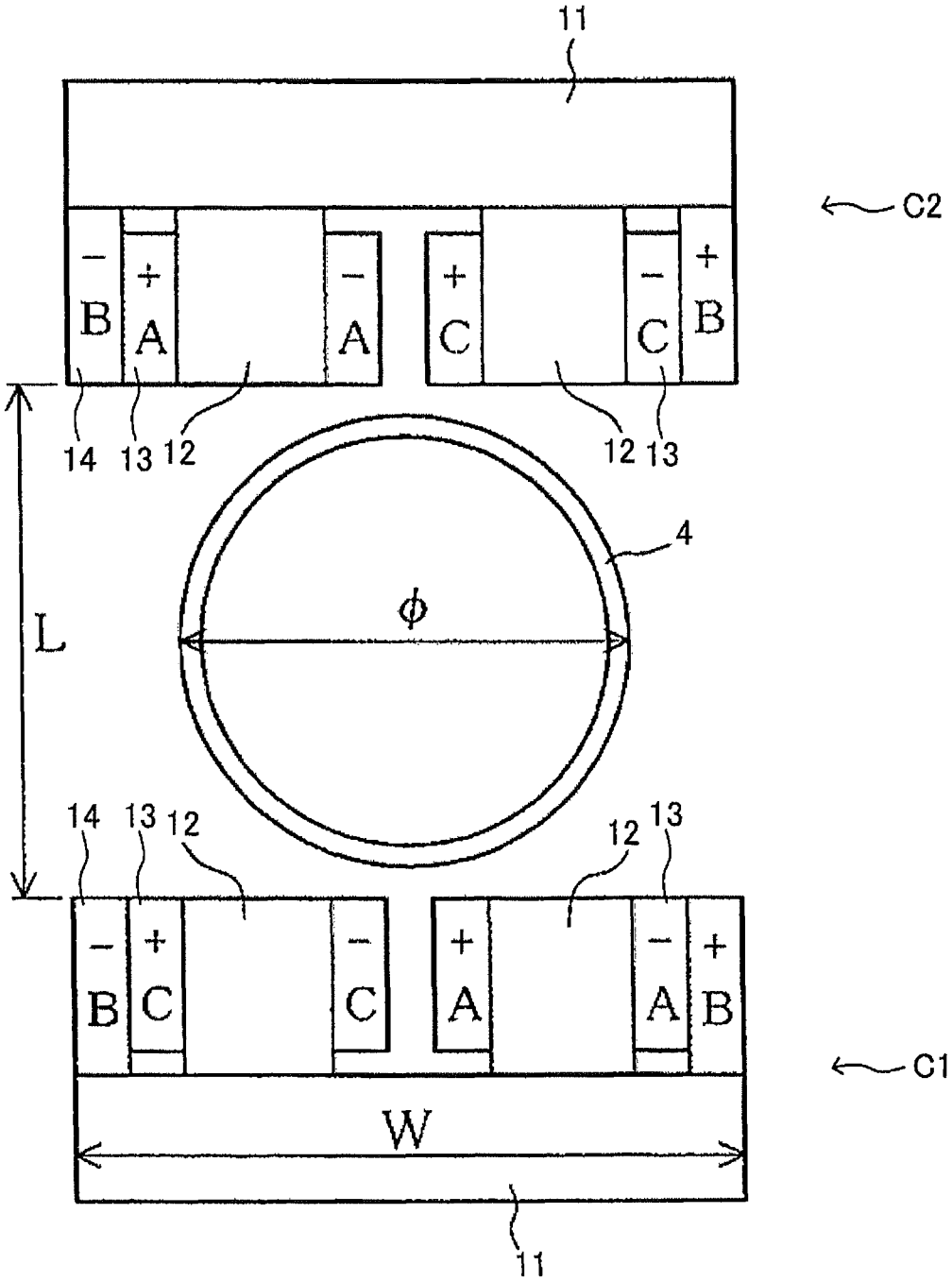
FIG. 2A is a view showing an outline of a pie-shaped electromagnetic coil and a window-type wiring system.
Figure 2B:
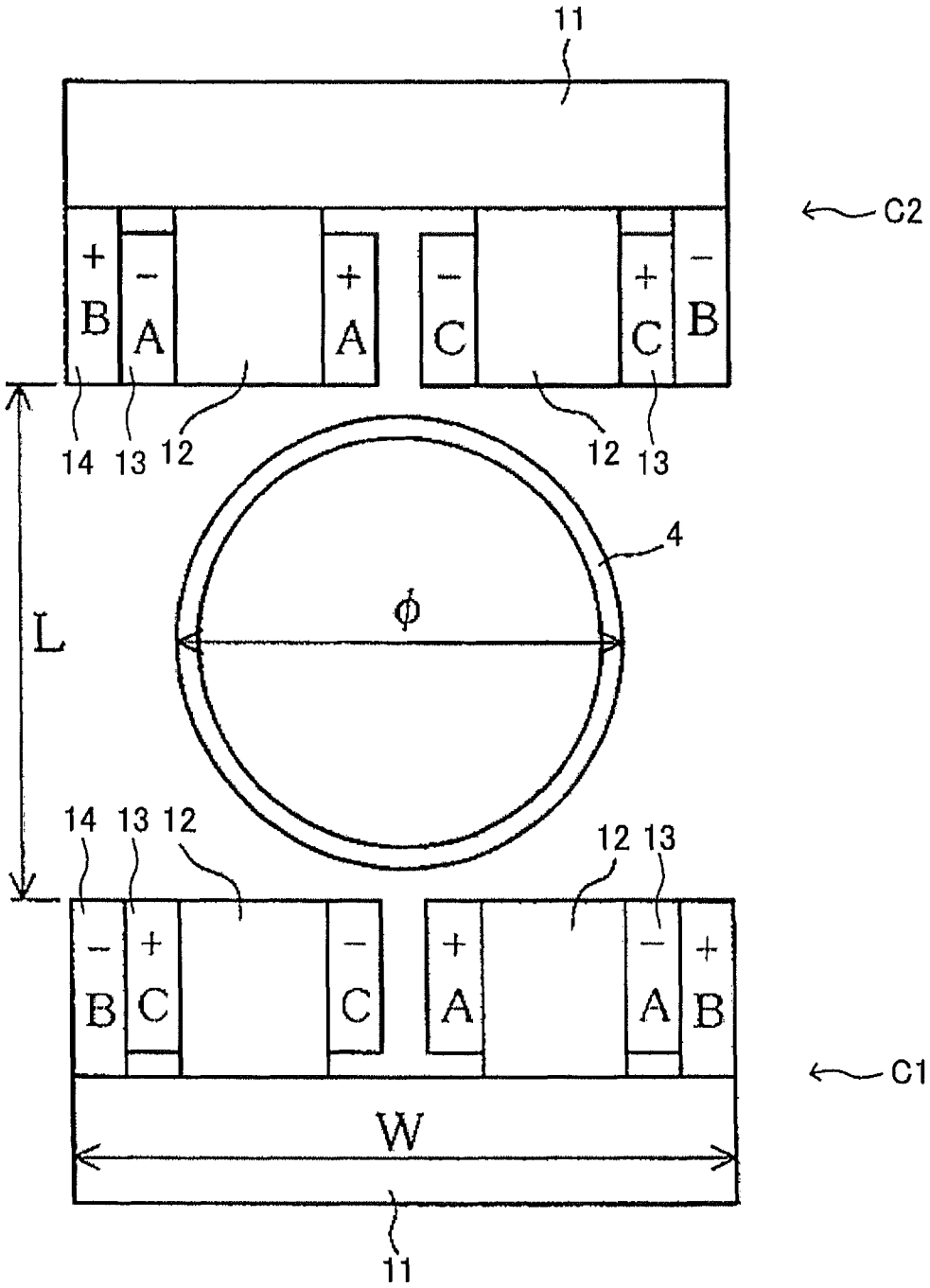
FIG. 2B is a view showing an outline of the pie-shaped electromagnetic coil and a symmetric wiring system.
Figure 4A:
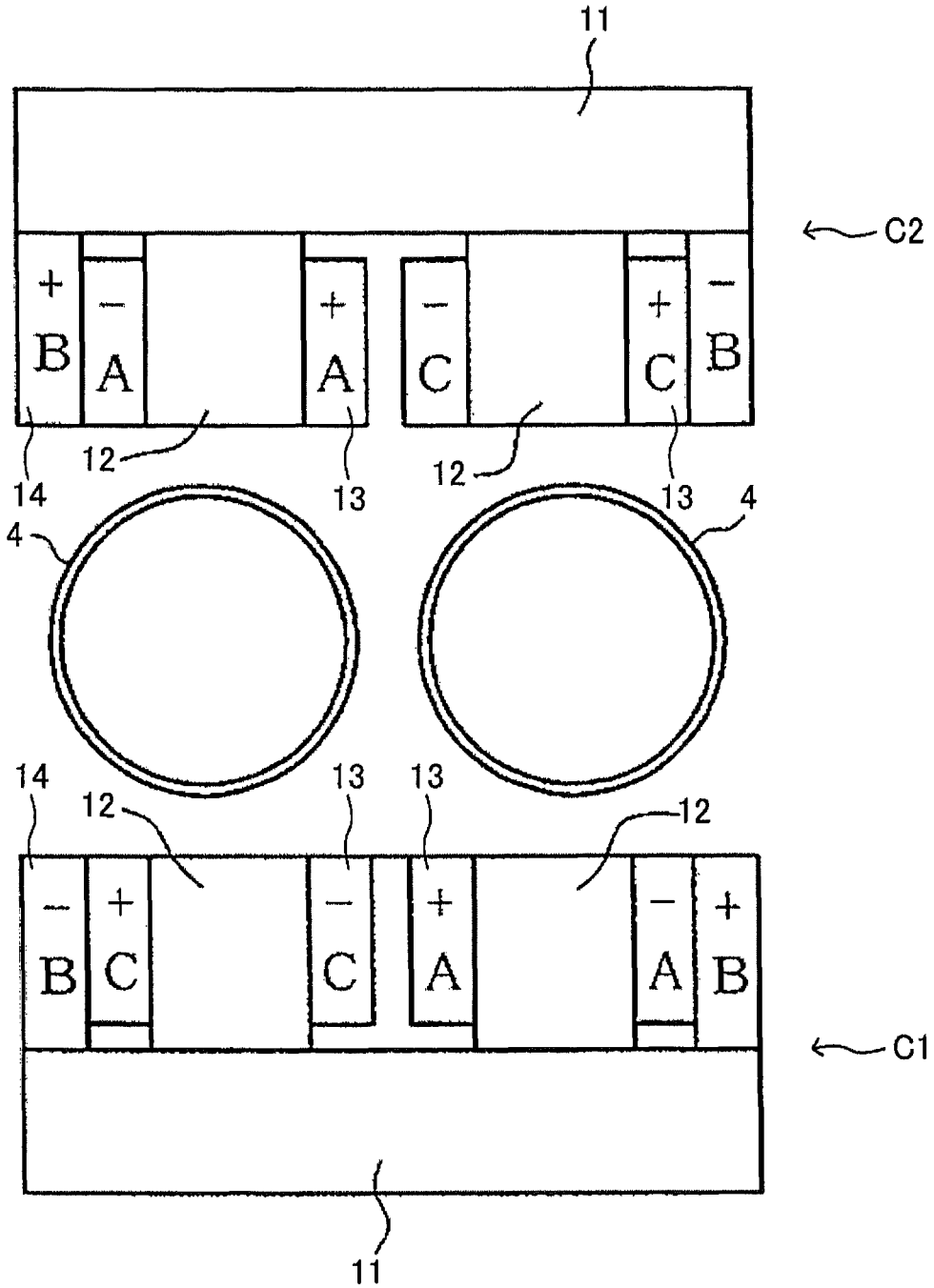
FIG. 4A is a view showing an outline of a case where two casting molds are installed (in a case where n=2)
Figure 4B:
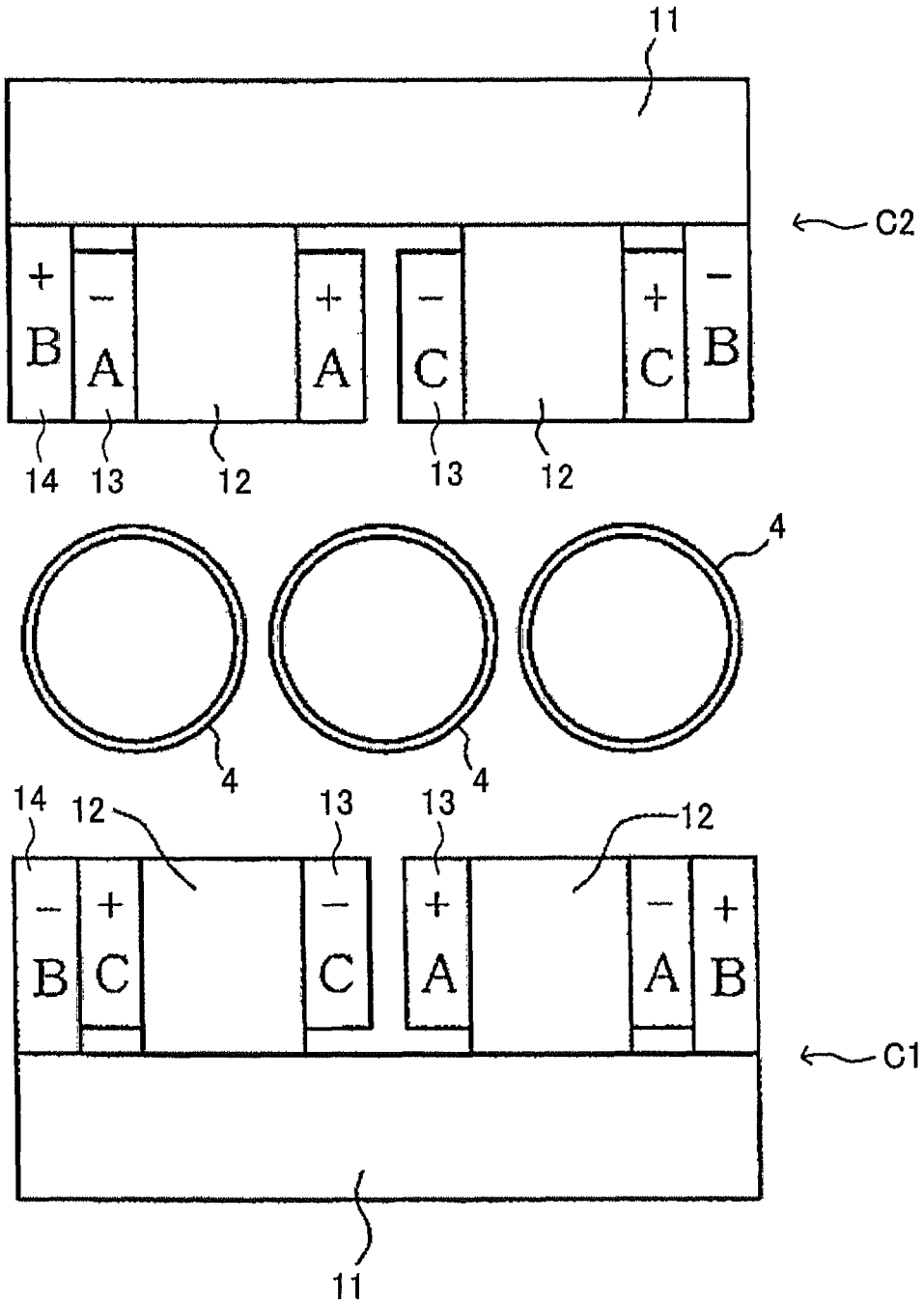
FIG. 4B is a view showing an outline of a case where three casting molds are installed (in a case where n=3)
Figure 5A:
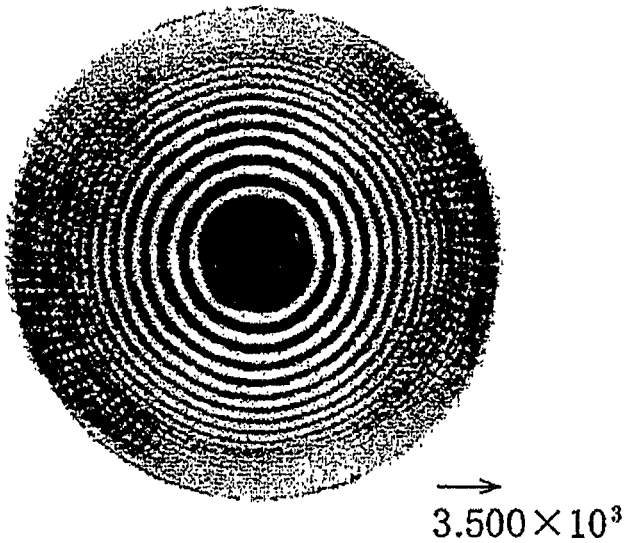
FIG. 5A is a view showing an electromagnetic force in a case where the window-type wiring system is employed, the view showing an analysis result in a case where one casting mold whose outer diameter is 360 mm is installed.
Figure 5B:
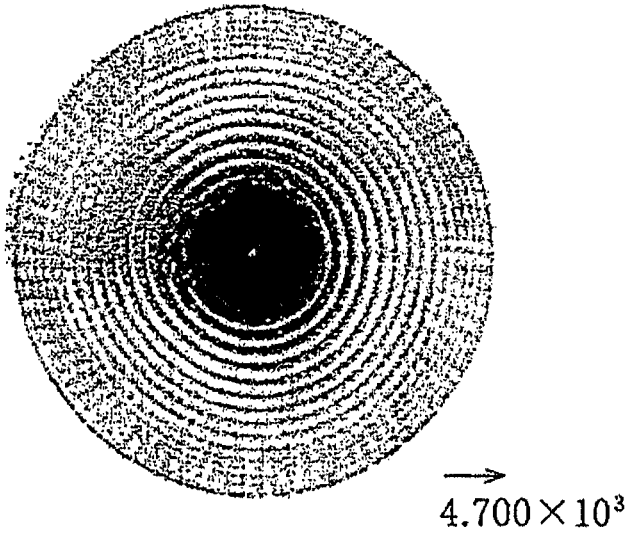
FIG. 5B is a view showing an electromagnetic force in a case where the window-type wiring system is employed, the view showing an analysis result in a case where two casting molds each having an outer diameter of 180 mm are installed.

Since the stirring by means of the electromagnetic stirrer of the present invention is an electromagnetic stirring by means of a stirrer having a pie-shaped iron core (core), a rotating magnetic field is not applied to each casting mold individually, but an electromagnetic force is generated by the electromagnetic field shifting parallel to the core and the three-phase alternating currents A, B and C each having phase difference of 120° to each other. Consequently, molten steel in the vicinity of the electromagnetic stirrer 5 (molten steel in the vicinity of the wall of the casting mold) flows along with the shift of the magnetic field, therefore, not only in a case where one casting mold 4 is used as shown in FIGS. 2A and 2B, but also in a case where a plurality of casting molds 4 are used as shown in FIGS. 4A and 4B, the molten steel in the vicinity of the electromagnetic stirrer 5 (molten steel in the vicinity of the wall of the casting mold) flows uniformly. Here, the right and left direction of the plane of paper of FIGS. 4A and 4B is the casting direction.

Examples

Hereinafter, Examples carried in order to confirm the effects of the present invention will be described.

The present invention applies an electromagnetic force to inside of the casting mold 4 by means of the electromagnetic stirrer 5 to uniformly flow the molten steel, thereby improving the inner quality of cast slabs. The electromagnetic stirrer 5 is disposed to a position where a meniscus exists, in a region between an end surface of one end side and an end surface of the other end side of the casting direction of the electromagnetic coils C1 and C2 each having a width in the casting direction of W.

As the electromagnetic stirrer 5 of the continuous casting system 100 shown in FIG. 1, the electromagnetic stirrer with symmetric wiring system shown in FIG. 2B was used. One or more of casting mold (s) whose diameter ϕ on the outer surface (outer diameter ϕ) is/are 180 mm, casting mold(s) whose outer diameter ϕ is/are 225 mm, casting mold (s) whose outer diameter ϕ is/are 265 mm, and casting mold (s) whose outer diameter ϕ is/are 400 mm were used. Continuous casting was carried out with the casting speed of 0.5 to 2.0 m/min, the applying current value to the electromagnetic coils of 300 to 600 A, and the intensity of magnetic field of 50 to 150 mT (millitesla). The measurement results of flow of molten steel in the casting molds are shown in Table 1.

Two kinds of electromagnetic stirrers having the width W of 550 mm and 400 mm, respectively, were prepared to be used. For the electromagnetic stirrer whose width W is 550 mm, the distance L between the electromagnetic coils C1 and C2 was set as two levels of 450 mm and 600 mm, and for the electromagnetic stirrer whose width W is 400 mm, the distance L between the electromagnetic coils C1 and C2 was set as only 600 mm, then the testing was carried out.

Also, in Table 1, regarding Examples 1 to 5 that satisfy the conditions defined in the present invention and Comparative Examples 6 to 8 that do not satisfy the conditions defined in the present invention, each condition and the minimum value Vmin of the flowing speed of molten steel to the casting direction in the vicinity of the casting mold after meniscus are shown.

In the following Table 1, when the incidence λ of surface defection is λ<0.5%, the electromagnetic stirrer was evaluated as "very good", when 0.5%≤λ<1.5%, the electromagnetic stirrer was evaluated as "good", and when 1.5%≤λ, the electromagnetic stirrer was evaluated as "poor". The evaluation is based on the surface defection, and the surface defection that can be handled by trimming applies to "very good" or "good", and the surface defection that cannot be handled by trimming because of high frequency of the defection applies to "poor".

TABLE 1

| No. | Classification | Wiring System | Number of Casting Mold | Outer Size of Casting Mold ϕ(mm) | n × ϕ | Width of Three-phase coil W (mm) | Distance Between Electromagnetic Coils L (mm) | Current of Electromagnetic Stirring (A) | Magnetic Field (mT) | Minimum Value of Flowing Speed of Molten Steel Vmin (cm/s) | Generation Rate of Defection (%) | Evaluation |
|---|---|---|---|---|---|---|---|---|---|---|---|---|
| 1 | Examples | Window-type | 1 | 400 | 400 | 550 | 600 | 600 | 148 | 23 | 0.3 | Very Good |
| 2 | | Symmetric | 2 | 225 | 450 | 550 | 450 | 600 | 143 | 21 | 0.4 | Very Good |
| 3 | | Window-type | 1 | 360 | 360 | 400 | 600 | 300 | 71 | 11 | 1.4 | Good |
| 4 | | Window-type | 2 | 265 | 530 | 550 | 600 | 300 | 76 | 15 | 1.0 | Good |
| 5 | | Symmetric | 3 | 180 | 540 | 550 | 450 | 300 | 73 | 13 | 1.2 | Good |
| 6 | Comparative | Symmetric | 1 | 400 | 400 | 550 | 600 | 300 | 72 | 5 | 2.1 | Poor |
| 7 | Examples | Window-type | 2 | 265 | 530 | 550 | 450 | 300 | 69 | 0 | 6.2 | Poor |
| 8 | | Window-type | 3 | 225 | 675 | 550 | 450 | 300 | 77 | 0 | 7.1 | Poor |

As shown in Table 1, Examples 1 to 5 in which the minimum value Vmin of the flowing speed of molten steel to the casting direction in the vicinity of the casting mold after meniscus is 10 cm/s or more each had the incidence λ of surface defection of no more than 1.5%, and it was possible to handle the defection by trimming. On the other hand, Comparative Examples 6 to 8 not satisfying the conditions of the continuous casting method of the present invention each had the incidence λ of surface defection of 1.5% or more, and it was not possible to handle the defection by trimming.

Needles to say, the present invention is not limited to the Examples described above, and the embodiments can be adequately modified as long as the embodiments are within the scope of technical ideas described in the claims of the present invention.

INDUSTRIAL APPLICABILITY

The present invention described above can be applied to any types of continuous casting such as bending type, vertical type, as long as it is a continuous casting. Also, the present invention can be applied not only to a continuous casting for slab but also to a continuous casting for bloom.

DESCRIPTION OF THE REFERENCE NUMERALS

C1, C2 electromagnetic coil
4 casting mold
5 electromagnetic stirrer
11 core
12 tooth part
13 inner winding
14 outer winding
100 continuous casting system for billet (continuous casting apparatus for billet)

The invention claimed is:

1. An electromagnetic stirrer configured to control flow of molten steel inside at least one casting mold of a continuous casting apparatus for billet, the electromagnetic stirrer comprising a pair of electromagnetic coils facing each other and including the at least one casting mold at predetermined intervals in between the pair of electromagnetic coils, wherein:

two tooth parts are provided to an iron coil of each of the pair of electromagnetic coils in a manner to project to a side of the at least one casting mold;

each of the two tooth parts includes an inner winding on outside thereof and the two tooth parts with the inner windings are wrapped up with an outer winding applied to outside of the inner windings; and currents A, B and C each having a phase difference of 120° to each other are applied to the inner windings and the outer winding from a power source of three-phase alternating current;

wherein:

when a distance L between the pair of electromagnetic coils disposed in a manner to face each other and to include the at least one casting mold in between is 500 mm or more, a current direction to be applied to the inner windings and the outer winding is, from one end side to the other end side of casting direction, for one of the pair of electromagnetic coils, −B, +C, −C, +A, −A, +B in the order mentioned, and for the other of the pair of electromagnetic coils, −B, +A, −A, +C, −C, +B in the order mentioned;

when the distance L is no more than 500 mm, a current direction to be applied to the inner windings and the outer winding is, from one end side to the other end side of the casting direction, for one of the pair of electromagnetic coils, −B, +C, −C, +A, −A, +B and for the other of the pair of electromagnetic coils, +B, −A, +A, −C, +C, −B; and when the number of the at least one casting mold to be disposed to a region between an end surface of one end side and an end surface of the other end side of the casting direction of the pair of electromagnetic coils is defined as n, the external size of each of the at least one casting molds is defined as ϕ (mm), and the width of each of the electromagnetic coils is defined as W (mm), the number of the at least one casting molds satisfies following formula:

$$n \times \phi < W.$$

2. A continuous casting method using an electromagnetic stirrer, the method comprising:

using the electromagnetic stirrer of claim 1 as the electromagnetic stirrer; and setting Vmin which is the minimum value of flow of molten steel to a circumferential direction of the at least one casting mold in the vicinity of the at least one casting mold after meniscus as 10 cm/s or more.

* * * * *